US005645190A

United States Patent [19]

Goldberg

[11] Patent Number: 5,645,190

[45] Date of Patent: Jul. 8, 1997

[54] ALUMINUM BEVERAGE CAN

[76] Inventor: Norton Robert Goldberg, 8029 Keeler, Skokie, Ill. 60076

[21] Appl. No.: 536,664

[22] Filed: Sep. 29, 1995

[51] Int. Cl.[6] ..... B65D 6/02

[52] U.S. Cl. ..... 220/674; 220/906

[58] Field of Search ..... 220/669, 670, 220/671, 674, 906, 623, 624, 608, 609, DIG. 13

[56] References Cited

U.S. PATENT DOCUMENTS

| | | | |
|---|---|---|---|
| D. 213,491 | 3/1969 | Beeman et al. | 220/DIG. 13 |
| D. 299,315 | 1/1989 | Kasanda | D9/398 |
| D. 303,086 | 8/1989 | Rothfos | D9/377 |
| D. 304,686 | 11/1989 | Jarrin | D9/368 |
| D. 353,044 | 12/1994 | Riley | D3/228 |
| 464,273 | 12/1891 | Brewington | 220/DIG. 13 |
| 2,870,871 | 1/1959 | Stevinson | 220/669 |
| 3,224,585 | 12/1965 | Scavuzzo et al. | 220/608 |
| 3,420,367 | 1/1969 | Carmichael | 220/906 |
| 3,871,541 | 3/1975 | Adomaitis | 220/608 |
| 5,279,442 | 1/1994 | Jentzsch et al. | 220/671 |
| 5,346,095 | 9/1994 | Deal | 220/DIG. 13 |

FOREIGN PATENT DOCUMENTS

| | | | |
|---|---|---|---|
| 547636 | 6/1993 | European Pat. Off. | 220/670 |
| 683617 | of 0000 | France | 220/DIG. 13 |

OTHER PUBLICATIONS

Gardner, *The Unexpected Hanging and Other Mathematical Diversions,* (Simon and Schuster, 1969), pp. 212–215.

*Primary Examiner*—Stephen J. Castellano
*Attorney, Agent, or Firm*—James W. Clement

[57] ABSTRACT

An aluminum beverage can the top wall of which, and preferably the bottom wall as well, are substantially in the form of (1) a regular polygon of at least four sides, (2) a Reuleaux triangle, (3) an extended Reuleaux triangle, (4) a symmetrical curve of constant width derived from a regular polygon having an odd number of sides at least five in number, or (5) an extended symmetrical curve of constant width derived in the same way.

19 Claims, 5 Drawing Sheets

ALUMINUM BEVERAGE CAN

FIELD OF INVENTION

This invention relates to an improved aluminum beverage can.

BACKGROUND OF INVENTION

A very large number of aluminum cans for beverages such as beer and soft drinks are produced in the United States—as well as in Canada, Australia, France, Germany, Argentina, Brazil, and elsewhere—each year. It has been estimated that the output of aluminum beverage cans in this country amounts to more than one hundred billion cans per year.

Aluminum beverage cans are today manufactured by the well known process known as two-piece drawing and wall ironing. As a part of this process, the bottom wall of the can and the bottom portion of the cylindrical side wall are made thicker than the upper portion of the side wall. The top wall or lid of the can is also thicker than the side wall, as well as being constructed from a different aluminum alloy than the other walls of the body are.

The top wall or lid of the can customarily has a substantially smaller diameter (typically about 2.1 inches or 53 mm.) than the inside diameter of the main body portion of the can (typically about 2.6 inches or 66 mm.). Even so, the lid constitutes about one-fourth the total weight of the can.

SUMMARY OF THE INVENTION

The aluminum beverage can of this invention includes a main body portion that has the shape of a right circular cylinder, and is of a given wall thickness. The bottom wall of the can and the bottom portion of the side wall have a wall thickness greater than the wall thickness of the upper part of the main portion. The top wall of the can likewise has a greater wall thickness than the main body portion has.

The top wall is substantially in the form of one of the following shapes:

- A polygon that has at least four sides, all of substantially equal length;
- A Reuleaux triangle;
- An extended Reuleaux triangle;
- A symmetrical curve of constant width derived from a regular polygon having an odd number of sides at least five in number; and
- An extended symmetrical curve of constant width derived from a regular polygon having an odd number of sides at least five in number.

(The term "regular polygon" is used in this specification and the appended claims in its accepted meaning of a polygon all of whose sides are of equal length and enclose equal angles at each corner.)

The maximum transverse dimension of the top wall is substantially smaller than the diameter of the main body portion.

An upper shoulder portion operatively connects the main body portion and the top wall. This portion is circular at its bottom, and at its top is substantially the same shape and size as the top wall is. There is an outlet opening in the top wall for pouring the beverage out of the can, and an airtight closure is provided that can be opened manually by the user.

When the top wall is polygonal in shape, it preferably has an even number of sides. It is further preferred that the polygon have eight sides. The corners of the polygon that defines the top wall should be slightly rounded.

The can of this invention usually includes a lower shoulder portion that operatively connects the main body portion and the bottom wall. This lower shoulder portion has a substantially smaller area at its bottom than the cross-sectional area of the main body portion.

The top wall of the can has a generally vertical ridge that extends around the perimeter of the top wall. When the can is to be stored by being stacked upon a second can of the same configuration and dimensions, the lower shoulder portion and the bottom wall are shaped and dimensioned to nest within the space defined by the ridge on the top surface of the second can, with the lower shoulder portion in substantial contact with the ridge at at least three points. When the can bottom wall has the same shape as the top wall, the contact extends substantially around the can.

ADVANTAGES OF THE INVENTION

As would be expected, one of the principal elements of cost in producing aluminum beverage cans is the amount of aluminum required. The average can today weighs about 0.48 ounces. A can of standard size holds 12 ounces of liquid and is not only light in weight but of rugged construction as well.

Research is constantly going forward seeking ways to maintain the typical aluminum beverage can's performance while reducing the amount of material needed to make the can. Because of the tremendous volume of beverage can production, reducing the can mass by only a small amount will result in a very substantial savings in material costs. It has been estimated that reducing the can's mass by one percent would save approximately $20 million a year in aluminum.

The present invention reduces the amount of aluminum required to produce a can by a significant amount in several ways:

1. When the can top is polygonal in shape rather than the conventional circular shape, portions of the circular top that are unnecessary are thereby eliminated and the amount of aluminum used for the top is reduced accordingly. At the same time, the amount of aluminum required for the upper shoulder portion is correspondingly reduced.

When the can top has another of the shapes covered by this invention, unnecessary portions of the circular top are likewise eliminated. Again, the amount of aluminum required for the upper shoulder portion is correspondingly reduced.

These savings of materials are referred to in this specification as savings of the first type.

2. The amount of aluminum required to make a can is further reduced when the can's bottom wall, like the top wall, is in a special form that eliminates portions of the conventional bottom wall. The amount of aluminum required for the lower shoulder portion is also reduced accordingly. These savings are referred to herein as savings of the second type.

3. Still further savings in the cost of materials, which are referred to in this specification as savings of the third type, can be achieved from a simple modification of the method of manufacture of can tops for the beverage can of this invention.

These various savings in the amount of aluminum required to produce a can are achieved without any significant lessening of the can's strength, utility or appearance. The noncircular form of the top wall of the can will of course not interfere with the pouring of the beverage out of the can.

At the same time, none of the shapes covered by this invention is so far removed from a circular top that it may seem strange to anyone who is drinking directly out of the can. As one example, an octagonal top is not so different from a circular top, and will seem to a person drinking from the can very much like the octagonal glass tumblers that have been used for many years.

BRIEF DESCRIPTION OF THE DRAWING

Embodiments of the aluminum beverage can of this invention will now be described in more detail, with reference to the accompanying drawing, in which.

DETAILED DESCRIPTION OF SPECIFIC EMBODIMENTS OF THE INVENTION

To illustrate the differences between the beverage can of this invention and cans of the prior art, a typical can as made today will first be described and illustrated, and then several preferred embodiments of the can of this invention will be described and illustrated.

Prior Art

Figure 1:
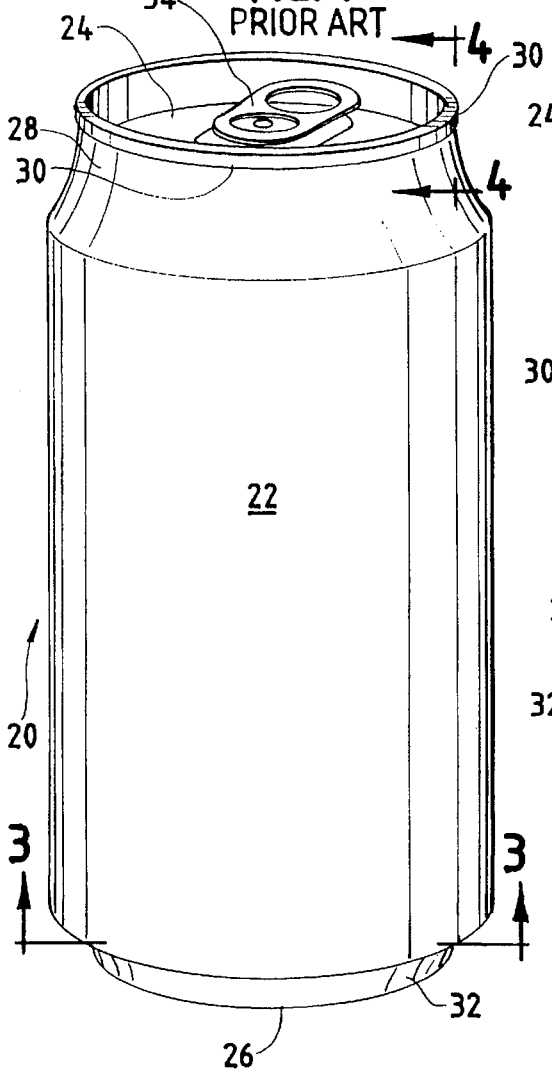
FIG. 1 PRIOR ART
FIG. 1 is a perspective view of a conventional prior art aluminum beverage can.

FIG. 1 is a perspective view of a conventional prior art aluminum beverage can. Can 20 includes main body portion 22, top wall 24, and bottom wall 26. Main body portion 22 is necked down at the top to form upper shoulder portion 28, which is operatively connected at seam or ridge 30 to top wall 24. Main body portion 22 is necked down at its bottom to form lower shoulder portion 32, which is operatively connected to bottom wall 26.

Top wall 24 defines an outlet opening for pouring the beverage out of the can. Airtight closure 34 is provided for the outlet opening. The closure can be opened manually by the user.

Figure 2:
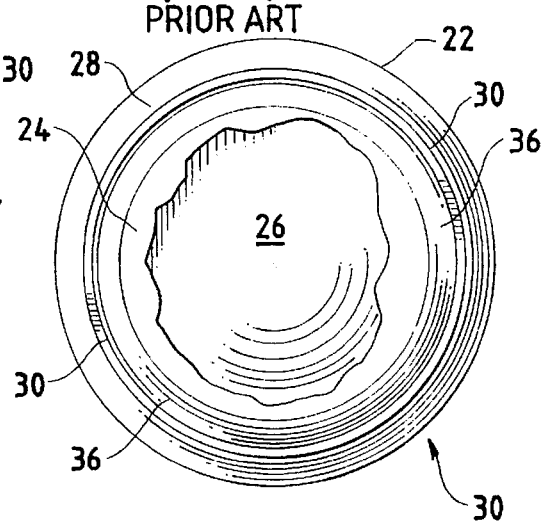
FIG. 2 PRIOR ART
FIG. 2 is a top plan view of the can shown in FIG. 1, with the top wall of the can partially broken away.

FIG. 2 is a top plan view of the can shown in FIG. 1, with top wall 24 partially broken away to show bottom wall 26. Seam or ridge 30 extends around the perimeter of top wall 24. Circular depression 36, just inside the inner surface of ridge 30, strengthens top wall 24.

Figure 3:
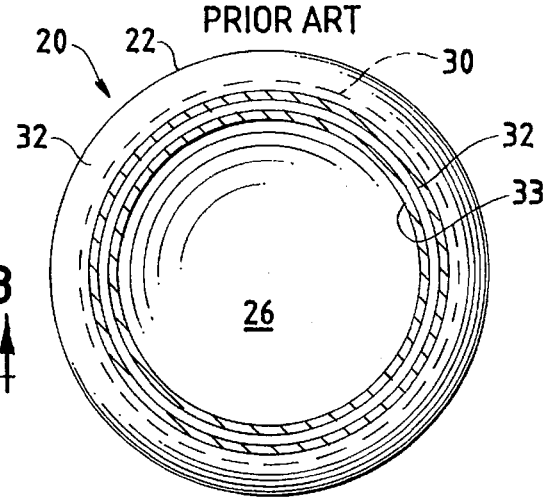
FIG. 3 PRIOR ART
FIG. 3 is a cross-sectional view of the can shown in FIG. 1, taken along line 3—3 in FIG. 1.

FIG. 3 is a cross-sectional view of the bottom part of the can shown in FIG. 1, taken along line 3—3 in FIG. 1. Ridge 30 on top wall 24 of can 20 is shown in dashed lines. The outer wall of lower shoulder portion 32 is shown in section, in vertical alignment with the inner surface of ridge 30 for substantially 360° around the can. Inner wall 33 is also shown in section inwardly spaced from the outer wall of the lower shoulder portion. The domed structure of bottom wall 26 is seen extending upward (in a direction perpendicular to the plane of the drawing and away from the viewer) above the bottom portion of lower shoulder portion 32. (The domed structure of the bottom wall is similar to domed bottom wall 65 shown in dashed lines for can 58 in FIG. 5 as described below.)

Figure 4:
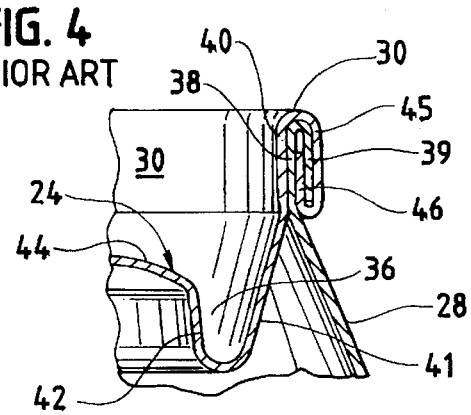
FIG. 4 PRIOR ART
FIG. 4 is an enlarged, fragmentary cross-sectional view taken along line 4—4 in FIG. 1.

FIG. 4 is an enlarged, fragmentary cross-sectional view taken along line 4—4 in FIG. 1. As is seen, portion 38 of upper shoulder 28 rises a short distance, and then extends downward at 39 to form part of seam 30. The other part of seam or ridge 30 is formed by top portion 40 of outer portion 41 (which defines depression 36 surrounding central portion 44) of top wall 24, together with successive folded outer portions 45 and 46 of the top wall. After the can is filled with beverage, members 40, 38, 46, 39 and 45 are bent and seamed to form seam or ridge 30, which secures the lid of the can in place.

First Embodiment of the Invention

When the top wall of the can of this invention is polygonal in shape, the polygon has at least four sides, which sides are of substantially equal length. However, for both structural and aesthetic reasons, a polygon having a larger number of sides—such as an octagon—is preferred.

The maximum transverse dimension of the polygonal top wall is in all cases substantially smaller than the diameter of the main body portion. The inside diameter of the main body portion of a conventional prior art aluminum beverage can is, as already mentioned above, about 2.6 inches (66 mm.). The typical inside diameter of the main body portion in a can according to the present invention is about the same. As in the prior art, the upper shoulder portion of the can of the present invention is typically "necked down" in internal diameter from about 2.6 inches (66 mm.) to about 2.1 inches (53 mm.) to accommodate a smaller top wall.

Figure 5:
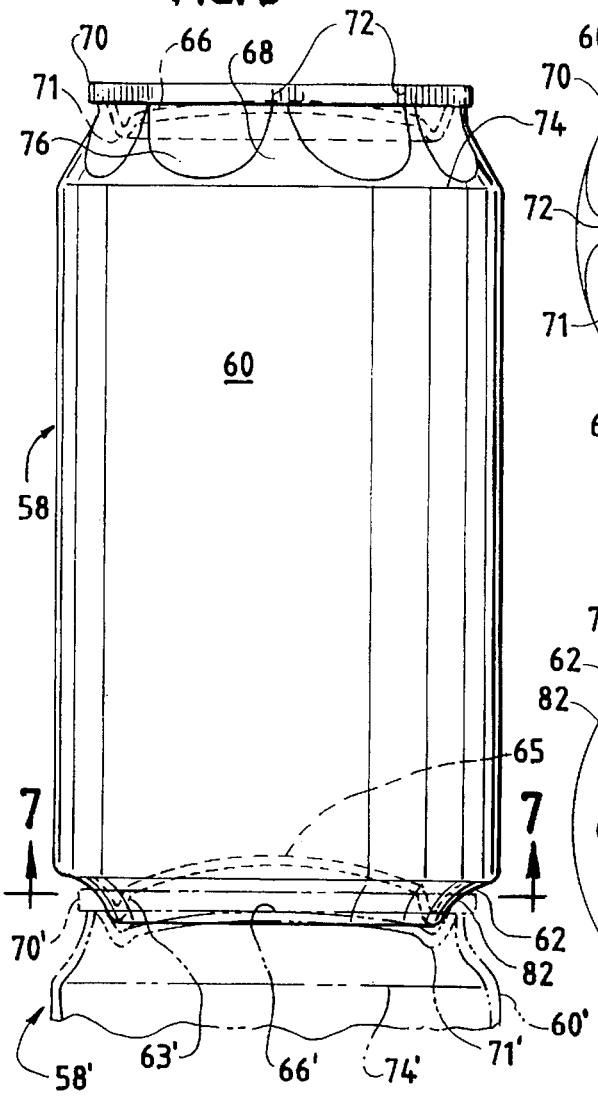
FIG. 5 is a side elevation view of one embodiment of the aluminum beverage can of this invention, nested with a can of the same type, only a fragment of the top portion of the can in the bottom position being shown (in dashed lines)
Figure 6:
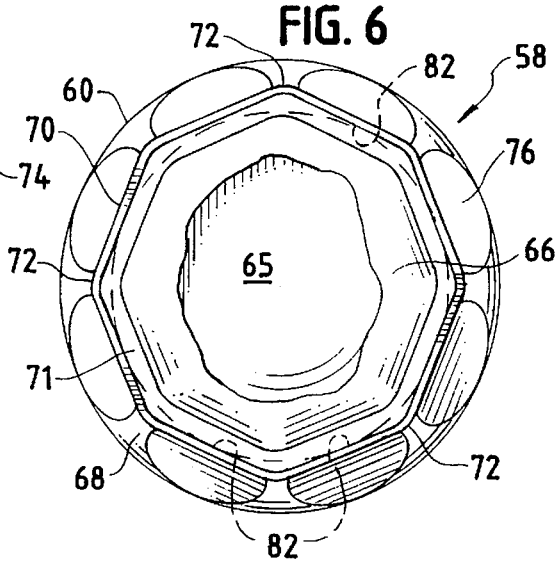
FIG. 6 is a top plan view of the can shown in FIG. 5 with the top wall of the can partially broken away.

FIG. 5 is a side elevation view of one preferred embodiment 58 of the aluminum beverage can of this invention. Body portion 60, necked-down lower shoulder portion 62, and bottom wall 65 are in this embodiment the same as in the prior art can shown in FIG. 1. However, slightly domed top wall 66, the top of upper shoulder portion 68, and seam or ridge 70 are all octagonal in shape—having eight sides of substantially equal length—rather than circular as in the prior art. The cross-sectional configuration of seam or ridge 70 is substantially the same as with seam 30 in the prior art aluminum beverage can of FIGS. 1 through 4.

Corners 72 of octagonal top wall 66 are preferably slightly rounded. Between each pair of adjacent corners 72, the top edge of upper shoulder 68 is comprised of straight line segments.

At its bottom edge 74, upper shoulder portion 68 is circular. For simplicity, sections 76 at the top of upper shoulder portion 68 are illustrated in the drawing as substantially flat surfaces. As shown in FIG. 5, the bottom edges of these flat surfaces may be spaced a distance above circular bottom edge 74 of the upper shoulder portion. In practice, circular bottom edge 74 of the upper shoulder portion may, if desired, merge into the perimeter of octagonal top wall 66 gradually, forming a continuously curved surface.

As will be seen, the opening in the top wall and the closure for that opening are omitted for clarity in FIGS. 5–9.

Figure 7:
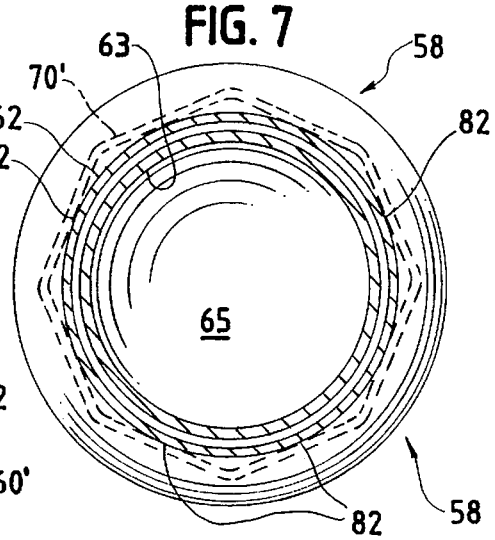
FIG. 7 is a cross-sectional view taken along line 7—7 in FIG. 5, showing two cans of the type shown in FIG. 5 nested together with the lower shoulder portion of the top can in contact with the ridge on the top wall (shown in dashed lines) of the can in the bottom position.

In FIG. 5, the top portion of another beverage can 58' is shown in phantom at the bottom of the Figure, with can 58 nested on top of it. During storage, cans 58 and 58' are stacked in this manner with other cans of the same type. Lower shoulder portion 62 of can 58 rests against the inner wall of ridge 70' at the top of can 58'. Contact points 82 are spaced about the cans, as indicated in FIG. 7. The outer wall of lower shoulder portion 62 and its inner wall 63 are shown in section in FIG. 7. Domed bottom wall 65 is seen in cross-section (in dashed lines) in FIG. 5, from above in FIG. 6, and from below in FIG. 7.

Figure 10:
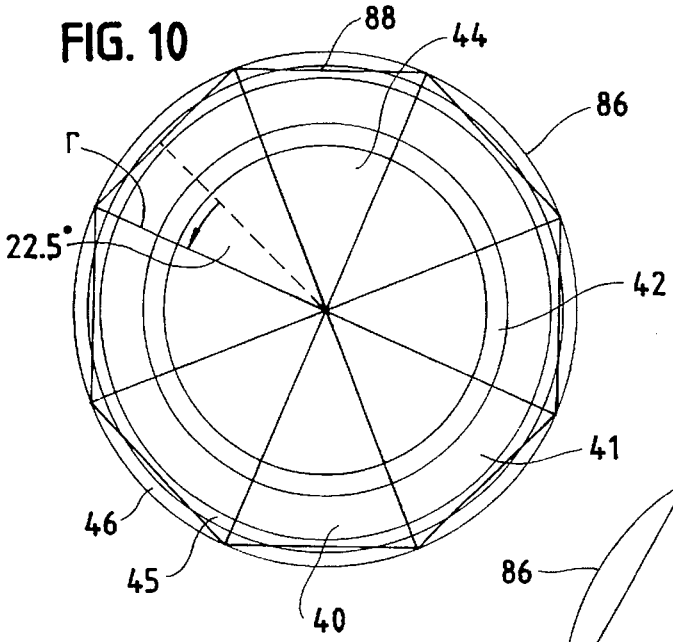
FIG. 10 (on the same sheet as FIGS. 14 and 15) is a diagrammatic showing of part of the savings in aluminum that is achieved through the use of an octagonal top wall.

FIG. 10 (on the same sheet as FIGS. 13, 14 and 15) illustrates the first type of savings in material that results from the use of an octagonal top wall instead of a circular top wall. As mentioned above, the inside diameter of the main body portion of a conventional prior art aluminum beverage can such as is shown in FIG. 1 is about 2.6 inches (66 mm.). Although the inside diameter of ridge or seam 30 on the finished top of a typical prior art can is about 2.1 inches (53 mm.), the diameter of the circular starting sheet 86 of aluminum before it is shaped into (a) the central, slightly domed, top wall portion 44 (which has a diameter of about 1.85 inches or 47 mm.), (b) side walls 42 and 41 of circular depression 36, and (c) walls 40, 45 and 46 of seam 30, is about 2.95+ inches (75 mm.), making a radius of about 1.48 inches (37.5 mm.).

Taking the radius of circular starting sheet 86 as 1.48 inches (37.5 mm.) in FIG. 10, the resulting area of the circular sheet is about 6.88 square inches (4,439 sq. mm.). In comparison to this, an octagonal starting sheet for production of an octagonal top wall 88 that has a maximum external dimension of about 2.95+ inches (75 mm.) results in a savings of about 10 percent in the material required to produce the top wall. The area of each of the eight triangular sectors that together make up octagon 88—computed as $(r \times \cos 22.5°) \times (r \times \sin 22.5°)$—is about 0.774 square inches (499 sq. mm.). Hence, the total area of the octagon is about 6.19 square inches (3,994 sq. mm.). This is a little more than 10 percent below the area of 6.88 square inches of material that is required for the circular top wall of a conventional beverage can.

As the can top ordinarily represents about 25 percent of the total weight of the can, the resulting savings in aluminum suggested by this analysis comes to about 2.5 percent of the total weight of the can as measured before the can top is modified according to the present invention. It has been estimated that decreasing the can weight by one percent should save approximately $20 million a year in aluminum. Reducing the can weight through use of octagonal top wall 66 will therefore produce a savings in the cost of materials of about $50 million each year.

The analysis just employed is a way of estimating the first type of savings of material through use of an octagonal top wall. Further savings of material, the second type, will result from the use (discussed below) of a bottom wall that has the same octagonal shape as the top wall. It is believed that the savings of material by the use of an octagonal bottom wall can be achieved simply by starting with the correspondingly reduced quantity of metal and ironing the metal wall into the desired octagonal shape. The same may be true of the savings of material that is derived from the octagonal shape of the top wall, or it may be necessary in that case to use a starting sheet that is already octagonal before it is drawn and ironed. In the latter case, the savings in material must be achieved by salvaging and recycling the extra material that is omitted (from what would otherwise be the round starting sheet for a conventional circular can top) in order to produce the noncircular can top of this invention.

Recycling is already practiced in the beverage can manufacturing industry in two ways. First, it is estimated that more than 63 percent of aluminum cans are now returned for remelting after they have been purchased, used and discarded. Second, recycling also has an important part within the aluminum mill itself. For every ton of can bodies made, it is believed that a ton of scrap metal is produced. This scrap is remelted and injected back into the manufacturing cycle.

Figure 11:
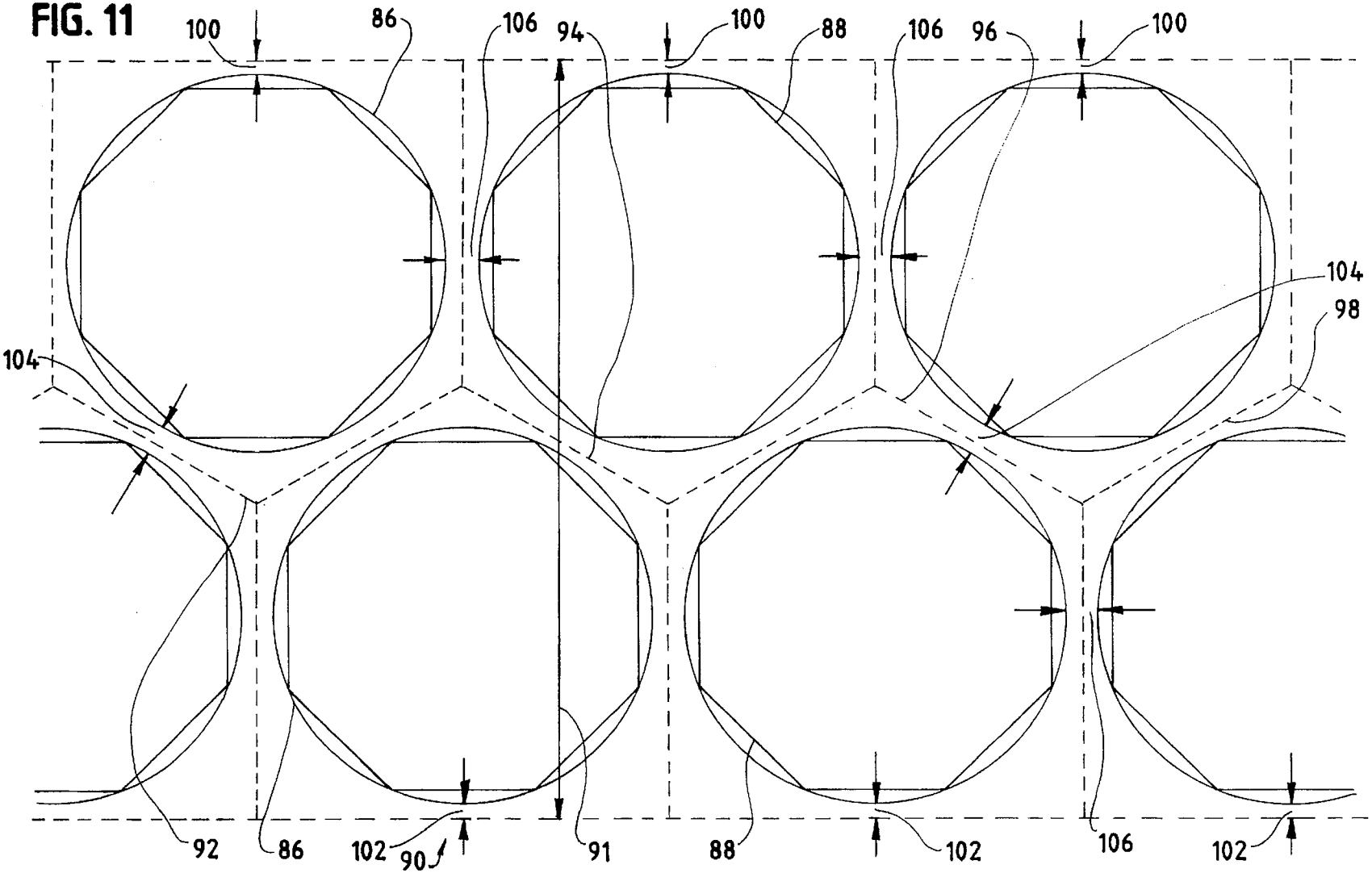
FIGS. 11 and 12 together provide a diagrammatic showing of an additional savings in the amount of aluminum required for the top wall that is achieved through a modification in the method of manufacture of an octagonal top wall.

An additional very significant savings in material, the third type, results from a modification of the manufacturing method by which the top of the can is formed. The manufacture of a conventional top wall begins with an aluminum alloy sheet such as long, narrow sheet 90 of which a fragment is shown in FIG. 11. Wedge-shaped blanks such as 92, 94, 96 and 98 are then cut from the sheet. One circular starting sheet 86 is cut from each wedge-shaped blank. A second machine then draws sheet 86, and several ironing steps further shape the metal, to produce a top wall such as shown in the prior art can of FIGS. 1 and 4, but without the final seam at this point.

Figure 12:
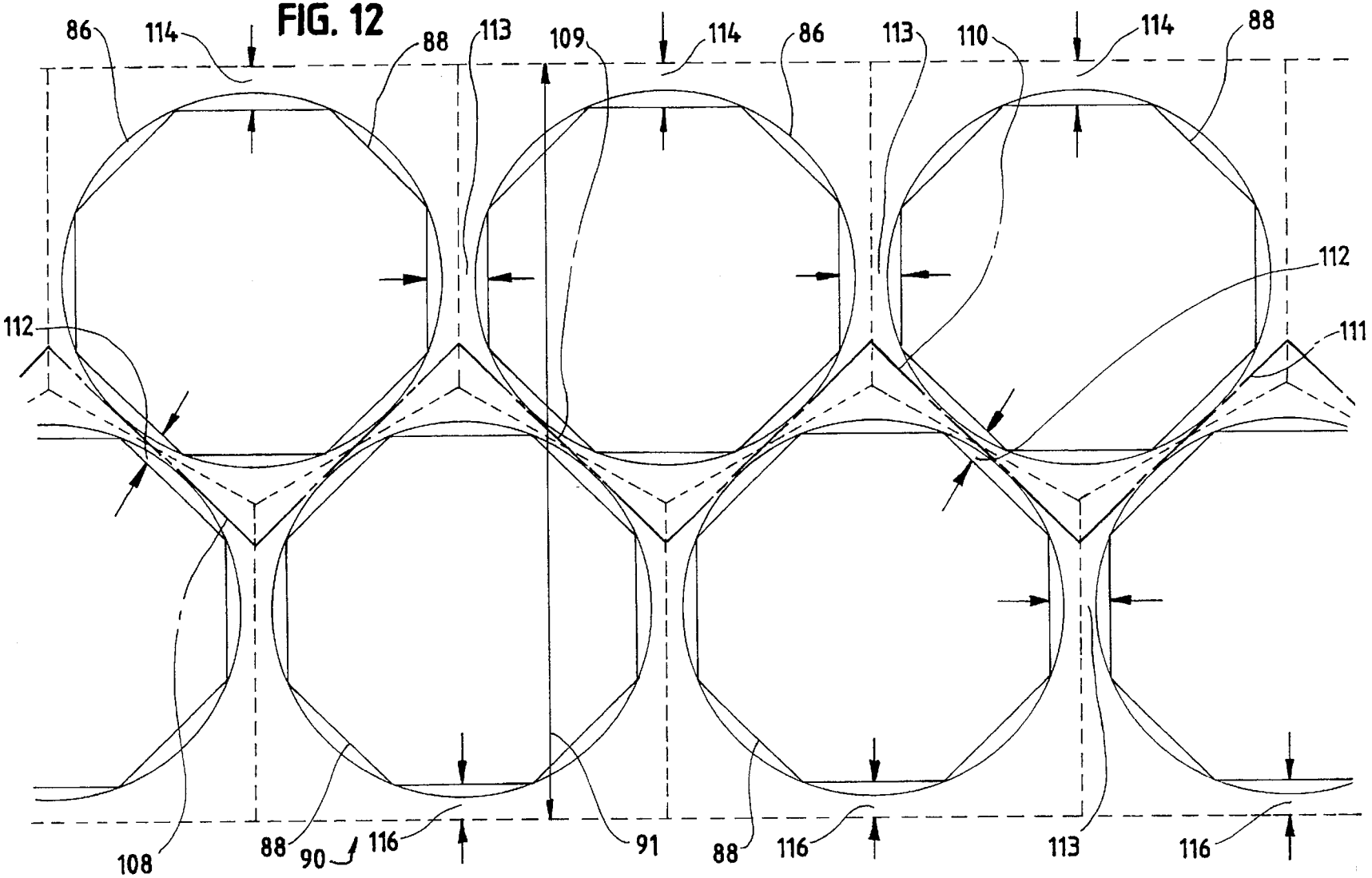

In FIG. 11, starting sheet 86 for a conventional circular top wall has a maximum transverse dimension—i.e., a diameter—of 75 mm. (The dimensions referred to in FIGS. 11 and 12 are the actual dimensions on the drawing sheets submitted as a part of this application for patent. The dimensions in FIGS. 11 and 12 of the official letters patent as issued will be smaller but will all be proportionately the same as the dimensions discussed herein.) The width 91 of long, narrow starting sheet 90 is about 155 mm. This leaves, as can be seen in FIG. 11, surplus material of approximately 3.5 mm. at margins 100 at the top of FIG. 11 and approximately 4.0 mm. at margins 102 at the bottom of FIG. 11. (Margins 104 between circular starting sheets 86 in the top and bottom rows and margins 106 between sheets 86 in the same row are about 7.5 mm. wide, which produces a margin of about 3.75 mm. on both sides of the dashed lines of wedge-shaped blanks such as 92, 94, 96 and 98.)

FIG. 12 shows how the octagonal shape of starting sheet 88 used in the production of a beverage can top according to the present invention permits the width of long, narrow starting sheet 90 to be significantly reduced, thereby saving a substantial amount of material. In FIG. 12, the outlines of octagonal starting sheets 88 have been moved inward from the two side edges of starting sheet 90. Wedge-shaped blanks such as 108, 109, 110 and 111 have been changed somewhat in shape, but margins 112 between octagons 88 in the top and bottom rows have remained about the same, approximately 7.75 mm., and margins 113 between octagons 88 in the same row have increased to approximately 14 mm. The most significant changes between FIGS. 11 and 12 are that margins 114 between octagons 88 and the upper edge of starting strip 90 have increased to about 9 mm., and margins 116 at the bottom edge of strip 90 have increased to about the same figure.

The combined width of new margins 114 and 116 in FIG. 12 (18 mm.) is about 10.5 mm. greater than the combined width of former margins 100 and 102 in FIG. 11 (7.5 mm.). The present width 91 of strip 90 is the same in both FIGS. 11 and 12 (155 mm.). Thus the width of starting strip can now be reduced in FIG. 12 by about 10.5 mm., and the margins at the top and bottom will remain the same as they are in FIG. 11. Since 10.5 mm. represents about 6.8 percent of the 155 mm. width of strip 90, there will be an additional savings of about 6.8 percent of the aluminum required for an octagonal top wall as compared to the conventional circular top wall of an aluminum beverage can. As the top wall of the conventional aluminum can represents about 25 percent of the weight of the can, the savings in the total amount of aluminum required for the can will be about 1.7 percent.

As mentioned above, an estimated cost savings of $20 million will result from each 1 percent of reduction in the weight of the necessary starting materials. This means that changing from the manufacturing process shown in FIG. 11 to that shown in FIG. 12 will result in an additional savings of the third type of $34 million in materials cost. This is an addition to materials savings of the first and second types which are achieved, as discussed above, through remelting the scrap from the manufacturing process and injecting it back into the cycle.

With this first embodiment of the invention, the savings in materials cost may turn out to be increased still further by the coincidental fact that the octagonal top edge of the upper shoulder portion in a typical two-piece drawing and wall ironing process will be wavy or "eared" at 45° intervals around the top edge. When the aluminum alloy is annealed after being hot-rolled from ingots, these so-called "ears" appear at 0°, 90°, 180° and 270° around the top edge of the side wall of the can. Four more ears result from cold-rolling of the sheet metal aluminum alloy, which produces ears at 45°, 135°, 225° and 315°. Since these eight ears at the top of the side wall are located in the same positions as the corners of the octagonal top, there may be some additional savings because it will not be necessary to trim off as much of the ears from the top edge of the side wall as is required when the top wall of the can is circular in form.

Second Embodiment of the Invention

Figure 13:
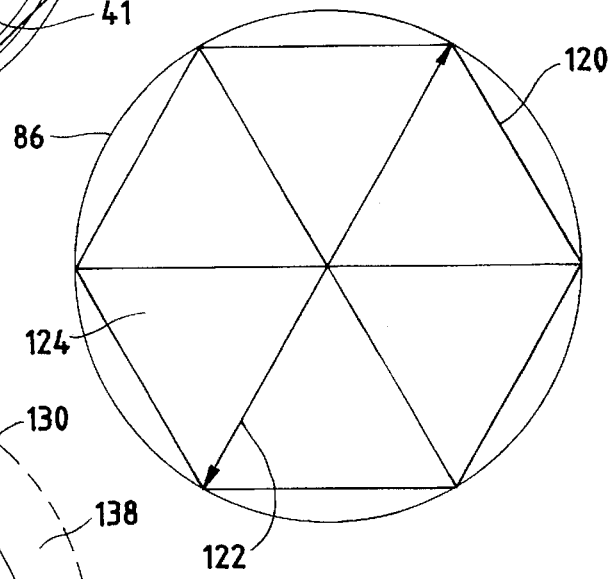
FIG. 13 (on the same sheet as FIGS. 1–4) is a diagrammatic showing of part of the savings in aluminum required for the top wall that is achieved through use of a hexagonal top wall.

FIG. 13 (on the same sheet as FIGS. 1–4) shows that a sheet of starting material 120 in the shape of a hexagon will save still more materials cost.

Again assuming a maximum dimension 122 of 2.95+ inches (75 mm.) for this can top, each triangular sector 124 has an area of about 0.95 square inches (613 sq. mm.), making the total area of the hexagon about 5.69 square inches (3.671 sq. mm.). Compared to 6.88 square inches for a circular starting sheet having a diameter of about 2.95+ inches (75 mm.), this represents about a 17.3 percent savings in materials for the can top.

As the can top ordinarily represents about 25 percent of the total weight of the can, the resulting savings in aluminum suggested by this analysis comes to about 4.3 percent of the total weight of the can. In terms of total dollar savings per year in aluminum costs, applying the same estimate mentioned above that a one percent decrease in aluminum cost will produce a $20 million per year reduction in material costs, the estimated savings of the first type with this hexagonal can top comes to about $86 million per year.

As in the case of the octagonal top of the first embodiment, further savings of the second and third type will result from making the bottom wall of the can hexagonal in shape, and from modifying the method of manufacturing of the can top by narrowing the starting strip from which the can tops are formed by moving the two rows of wedge-shaped blanks closer together.

Third Embodiment of the Invention

As already indicated, further savings in material costs (called in this specification savings of the second type) will be produced by making the bottom wall in the same polygonal shape as the top wall of the can.

Figure 8:
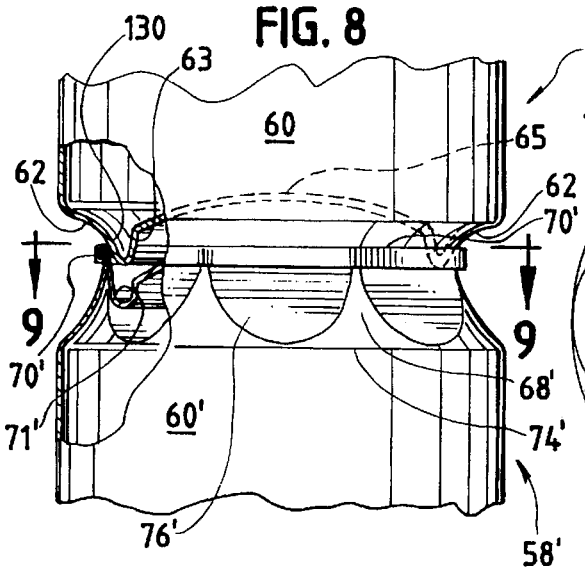
FIG. 8 is a fragmentary side elevation, partially broken away, of two of the aluminum beverage cans of this invention which have both a polygonal top wall and a polygonal bottom wall, showing the bottom portion of the upper can nested within the ridge on the top wall of the lower can.
Figure 9:
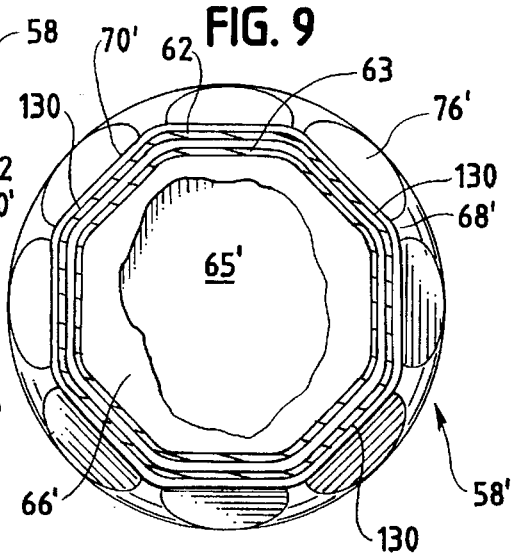
FIG. 9 is a sectional view of the nested cans of FIG. 8, showing the top can in contact with the ridge on the top wall of the bottom can substantially throughout the inner perimeter of the ridge.

FIG. 8 is a fragmentary, partially broken away, side elevation of cans 58 and 58', each of which has both an octagonal top wall and an octagonal bottom wall, stacked one on the other. FIG. 9 is a cross-sectional view taken along line 9—9 in FIG. 8. Bottom wall 65 of the upper can shown in FIG. 8 is 22½" displaced from the position occupied by top wall 66 of the can shown in FIG. 5. As will be seen, the octagonal shaped top and bottom walls of a given can do not need to be in alignment so long as the top wall of the bottom can and the bottom wall of the top can of a nested pair of cans are in alignment, as shown in FIGS. 8 and 9.

As will be seen from these two Figures, contact 130 between lower shoulder portion 62 of the top can and ridge 70' on the lower can extends substantially continuously around the can. Although the bottom of an aluminum beverage can is not ordinarily as heavy as the top, it is nonetheless heavier than most of the side wall portions of the can. For this reason, making the bottom wall of the can polygonal in shape to correspond to the top wall will achieve a significant additional savings in material costs.

Fourth Embodiment of the Invention

Figure 14:
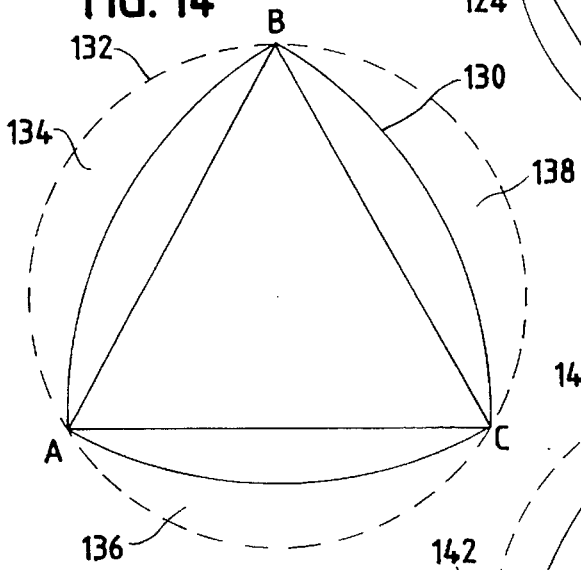
FIG. 14 is a plan view of a Reuleaux triangle, which is an alternative aluminum-saving shape for a can top.

FIG. 14 illustrates another shape for the beverage can top according to this invention, which is the so-called "Reuleaux triangle." As explained at page 213 of Gardner, *The Unexpected Hanging and Other Mathematical Diversions* (Simon and Schuster 1969), this geometric shape is produced as follows:

1. Draw equilateral triangle ABC in FIG. 14.
2. With the point of a compass at A, draw arc BC.
3. In a similar manner, draw arcs AC and AB to complete the shape shown in FIG. 14.

The resulting geometric shape, which has three curved sides, is commonly known as a "Reuleaux triangle."

As shown in FIG. 14, Reuleaux triangle 130 is one of the geometric shapes that in this invention can be used to replace circular top wall 132. Curved sectors 134, 136 and 138 indicate the savings of material of the first type that is achieved by this embodiment of the invention. Significant savings of materials of the second and third types will also result from the use of this shape for the can top and bottom walls.

Fifth Embodiment of Invention

Figure 15:
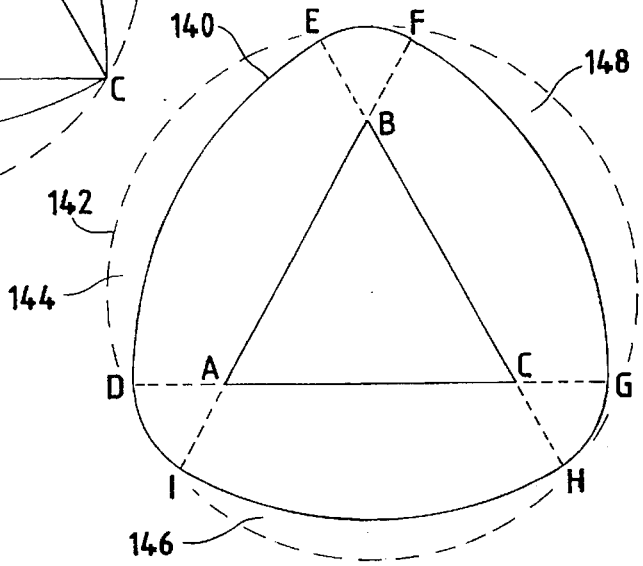
FIG. 15 is a plan view of an extended Reuleaux triangle, which is still another alternative aluminum-saving shape for a can top.

Another geometric shape that can be used for the top wall of the beverage can according to this invention is an extended Reuleaux triangle such as is shown in FIG. 15. In this Figure the corners of the Reuleaux triangle of FIG. 14 are rounded off by extending each side of an equilateral triangle ABC a uniform distance at each end. The steps in drawing an extended Reuleaux triangle are explained at page 215 of the Gardner text referred to above as the following:

1. With the point of the compass at A in FIG. 15, draw arc DI.

2. Widen the compass by distance AC and, with the point of the compass at A, draw arc FG on the opposite side of the figure.

3. Do the same two steps at the other corners, B and C.

As will be seen from FIG. 15, use of an extended Reuleaux triangle 140 produces savings in material of the first type, when compared to the circular can top 142, that is represented by curved sectors 144, 146 and 148. Significant savings of materials of the second and third types will also result from the use of this shape for the can top and bottom walls.

Other Embodiments

The Reuleaux triangle is the curve of constant width that has the smallest area for a given width. Still other geometric shapes that can be used in a beverage can according to this invention are:

A symmetrical curve of constant width derived from a regular polygon having an odd number of sides at least five in number. This curve can be drawn by following the same steps as described above for the drawing of a Reuleaux triangle, adapting the method to the larger number of sides.

An extended symmetrical curve of constant width derived from a regular polygon having an odd number of sides at least five in number. This curve can be drawn by following the steps described above for drawing an extended Reuleaux triangle, adapting the method to the larger number of sides.

Any of the above described geometric shapes can be used for the top wall and bottom wall of the beverage can of this invention. Each one will provide a substantial savings in material of the first and second types because of the elimination of unnecessary parts of the conventional circular top and bottom walls, and of the third type because of the modification of the conventional method of manufacturing can tops by using a narrower starting strip of metal.

In making the choice of which geometric form to use for the top wall of a beverage can according to this invention, a balance will be struck as to the money to be saved, the appearance of the resulting shape of the can top, and the probable degree of acceptance of a novel shape by the ultimate purchasers of the canned beverage.

While this invention has been described in connection with the best mode presently contemplated by the inventor for carrying out his invention, the preferred embodiments described are for purposes of illustration only, and are not to be construed as constituting any limitation of the invention. Modifications will be obvious to those skilled in the art, and all modifications that do not depart from the spirit of the invention are intended to be included within the scope of the appended claims.

I claim:

1. An aluminum beverage can which comprises:

(a) a main body portion having (i) the shape of a right circular cylinder, (ii) a given diameter, and (iii) a given wall thickness;

(b) a bottom wall (i) operatively connected to the main body portion, and (ii) having a wall thickness greater than the given wall thickness of the main body portion;

(c) a top wall that (i) has a maximum transverse dimension substantially smaller than the given diameter of the main body portion, (ii) has a wall thickness greater than the given wall thickness of the main body portion, (iii) has an outlet opening defined therein for pouring the beverage out of the can, and (iv) is substantially in the form of a geometric shape taken from the class consisting of:

a polygon having at least four sides, all of which sides are of substantially equal length, a Reuleaux triangle, an extended Reuleaux triangle, a symmetrical curve of constant width derived from a regular polygon having an odd number of sides at least five in number, and an extended symmetrical curve of constant width derived from a regular polygon having an odd number of sides at least five in number;

(d) an airtight closure for said outlet opening, which closure can be opened manually by the user; and (e) an upper shoulder portion that (i) is operatively connected to the main body portion and to the top wall, (ii) is circular at the bottom, (iii) is substantially the same shape and size as the top wall at the top, and (iv) necks down in size from the bottom of said shoulder portion up to the top of the shoulder portion.

2. The aluminum can of claim 1 in which the top wall is in the shape of a polygon having an even number of sides all of which are of substantially equal length.

3. The aluminum can of claim 2 in which the top wall is in the shape of a hexagon the sides of which are all of substantially equal length.

4. The aluminum can of claim 2 in which the top wall is in the shape of an octagon the sides of which are all of substantially equal length.

5. The aluminum can of claim 1 in which the top wall is in the shape of a Reuleaux triangle.

6. The aluminum can of claim 1 in which the top wall is in the shape of an extended Reuleaux triangle.

7. The aluminum can of claim 1 in which the top wall is in the shape of a curve of constant width derived from a regular polygon having an odd number of sides at least five in number.

8. The aluminum can of claim 1 in which the top wall is in the shape of an extended curve of constant width derived from a regular polygon having an odd number of sides at least five in number.

9. The aluminum can of claim 1 which includes a lower shoulder portion that: (i) is positioned between the main body portion and the bottom wall, (ii) is operatively connected to both said members, (iii) has a bottom of a substantially smaller area than the cross-sectional area of the main body portion, and (iv) necks down in size from the top of said shoulder portion down to the bottom of the shoulder portion.

10. The aluminum can of claim 9 in which:

(a) the top surface of the can includes a generally vertical ridge that extends around the perimeter of the top wall; and (b) the lower shoulder portion and the bottom wall are shaped and dimensioned to nest within the space defined by the ridge on the top wall of another can, with the lower shoulder portion substantially in contact with the ridge at at least three points, when one can is stacked upon a second can of the same shape and dimensions.

11. The aluminum can of claim 9 in which the perimeter of the bottom wall has the same shape as the perimeter of the top wall of the can.

12. The aluminum can of claim 10 in which the perimeter of the bottom wall has the same shape as the perimeter of the top wall of the can.

13. The aluminum can of claim 12 in which both the top wall and the bottom wall are in the shape of an octagon the sides of which are all of substantially equal length.

14. The aluminum can of claim 2 in which the corners of the polygon that defines the top wall are slightly rounded.

15. The aluminum can of claim 14 in which the polygon that defines the top wall is comprised of straight line segments between each pair of adjacent rounded corners.

16. The aluminum can of claim 3 in which the corners of the hexagon that defines the top wall are slightly rounded.

17. The aluminum can of claim 16 in which the hexagon that defines the top wall is comprised of straight line segments between each pair of adjacent rounded corners.

18. The aluminum can of claim 4 in which the corners of the octagon that defines the top wall are slightly rounded.

19. The aluminum can of claim 18 in which the octagon that defines the top wall is comprised of straight line segments between each pair of adjacent rounded corners.

* * * * *